US010448678B2

(12) United States Patent
Randall et al.

(10) Patent No.: US 10,448,678 B2
(45) Date of Patent: Oct. 22, 2019

(54) BRA INCORPORATING SHAPE MEMORY POLYMERS AND METHOD OF MANUFACTURE THEREOF

(71) Applicant: Mast Industries (Far East) Limited, Kowloon (HK)

(72) Inventors: Tracey Randall, New York, NY (US); Stephanie Kristin Muhlenfeld, Portland, OR (US); Mayur Vansia, Wayne, NJ (US); Shunichi Hayashi, Chita (JP)

(73) Assignee: MAST INDUSTRIES (FAR EAST) LIMITED, Kowloon (HK)

( * ) Notice: Subject to any disclaimer, the term of this patent is extended or adjusted under 35 U.S.C. 154(b) by 820 days.

(21) Appl. No.: 14/809,835

(22) Filed: Jul. 27, 2015

(65) Prior Publication Data

US 2016/0044971 A1 Feb. 18, 2016

Related U.S. Application Data

(60) Provisional application No. 62/036,723, filed on Aug. 13, 2014, provisional application No. 62/116,081, filed on Feb. 13, 2015.

(51) Int. Cl.
*A41C 3/00* (2006.01)
*A41C 3/14* (2006.01)

(52) U.S. Cl.
CPC ..... *A41C 3/0057* (2013.01); *A41C 3/142* (2013.01)

(58) Field of Classification Search
CPC ..... A41C 3/0057
See application file for complete search history.

(56) References Cited

U.S. PATENT DOCUMENTS 6,198,204 B1 3/2001 Pottenger
6,478,656 B1 * 11/2002 Khouri ..... A41C 3/10 450/1

(Continued)

FOREIGN PATENT DOCUMENTS

JP 3684504 8/2005
JP 2007-159603 6/2007

(Continued)

OTHER PUBLICATIONS

Search Report for EP15180804 dated Dec. 9, 2015.

(Continued)

*Primary Examiner* — Alissa J Tompkins
*Assistant Examiner* — Brieanna Szafran
(74) *Attorney, Agent, or Firm* — Andrus Intellectual Property Law, LLP

(57) ABSTRACT

A front panel for a sports bra has an interior liner layer having a back face contacting a wearer's skin, and an exterior shell layer having a back face facing a front face of the interior liner layer and coupled to the interior liner layer. A film layer is located between the front face of the interior liner layer and the back face of the exterior shell layer. The film layer becomes stiffer as a frequency of movement of a wearer's breasts increases, thereby absorbing forces caused by the movement of the wearer's breasts. A method for constructing a sports bra front panel with a thermally-induced shape memory polymer that exhibits viscoelastic properties when at body temperature and stiffens to absorb between about 0.015 N and about 0.03 N of force at frequencies of breast movement of between about 6 Hz and about 15 Hz is also disclosed.

17 Claims, 13 Drawing Sheets

(56) References Cited

U.S. PATENT DOCUMENTS

| | | | | |
|---|---|---|---|---|
| 9,210,955 | B2 | 12/2015 | Dandapure et al. | |
| 9,603,392 | B2 | 3/2017 | Dandapure et al. | |
| 2002/0022432 | A1* | 2/2002 | Magrone | A41C 3/0014 450/41 |
| 2003/0232571 | A1* | 12/2003 | Weinerth | A41C 3/10 450/41 |
| 2005/0218710 | A1 | 10/2005 | Browne et al. | |
| 2005/0245719 | A1 | 11/2005 | Mather et al. | |
| 2007/0082579 | A1* | 4/2007 | Baran | A41C 3/00 450/77 |
| 2010/0291835 | A1* | 11/2010 | Omoto | C08G 18/48 450/39 |
| 2012/0000251 | A1 | 1/2012 | Hu | |
| 2013/0225045 | A1* | 8/2013 | Dandapure | A41C 3/00 450/39 |
| 2014/0128491 | A1 | 5/2014 | Hayashi | |
| 2014/0342629 | A1* | 11/2014 | Nakatsuka | D01F 8/16 442/181 |
| 2014/0349550 | A1* | 11/2014 | Campbell | A41C 3/0021 450/60 |
| 2015/0044941 | A1* | 2/2015 | Luxi | A41C 3/0007 450/41 |
| 2015/0056890 | A1 | 2/2015 | Black et al. | |
| 2015/0087204 | A1* | 3/2015 | Conde | A41C 3/142 450/93 |

FOREIGN PATENT DOCUMENTS

| | | | |
|---|---|---|---|
| JP | 2009-072986 | | 4/2009 |
| JP | 2016-141709 | A | 8/2016 |
| WO | 2014049390 | A1 | 4/2014 |
| WO | 2015048152 | | 4/2015 |

OTHER PUBLICATIONS

Griggs, Brandon, "Researchers Develop Bionic Bra", online news article, Dec. 11, 2014, http://www.cnn.com/2014/12/11/living/bionic-bra/index.html?hpt=hp_t2, website visited on Dec. 15, 2014.

Boschma, Anne, "Breast Support for the Active Woman: Relationship to 3D Kinematics of Running", abstract of master's thesis presented Sep. 23, 1994.

D30 Comfort and Cushioning Materials, http://www.d3o.com/materials/comfort-and-cushioning/, web site visited on Jun. 10, 2015.

SMP Technologies Inc, "Intelligent Material—Able to Adjust Itself Accordingly to Ensure the Highest Level of Comfort & Affinity With Human Body", 2015, http://www2.smptechno.com/en/tech/pdf/2015SMP%20Tech%20E-Catalogue.pdf, web site visited on Jun. 10, 2015.

Plastics Technology, "Materials: Shape-Memory TPU Could Deter Counterfeiters", Jun. 2012, http://www.ptonline.com/products/materials-shape-memory-tpu-could-deter-counterfeiters, web site visited on Jun. 10, 2015.

New Balance, The Smooth Operator, http://www.newbalance.com/pd/the-smooth-operator/WBT3313.html#color=Black, web site visited on Jun. 10, 2015.

SMP Technologies Inc, "Properties and Applications of Shape Memory Polymer", Feb. 12, 2010, http://www2.smptechno.com/en/tech/pdf/entech1101.pdf, web site visited on Jun. 10, 2015.

SMP Technologies Inc, "Shape Memory Polymer (SMP) Guide for Injection/Extrusion Molding", Jun. 20, 2014, http://www2.smptechno.com/en/news/pdf/SMP%20Guide%20for%20Injection%E3%80%80Extrusion%20molding.pdf, web site visited on Jun. 10, 2015.

Shock Absorber, Ultimate Run Bra, http://www.shockabsorber.co.uk/en/products/ultimate-range/ultimate-run-bra/, web site visited on Jun. 10, 2015.

Srivastava et al., "Thermally Actuated Shape-memory Polymers: Experiments, Theory, and Numerical Simulations", MIT Open Access Articles, Jul. 26, 2011.

Sweaty Betty Ultra Run Bra, http://www.sweatybetty.com/clothes/underwear/bras-pants/white-ultra-run-bra/?change_site=main, web site visited on Jun. 10, 2015.

Syzygy Memory Palstics, Company Overview, http://www.memoryplastics.com/company, web site visited on Jun. 10, 2015.

SMP Technologies Inc, "A Film and Composite Fabric", Unpublished Japanese Patent Appl. No. 2015-017206, filed Jan. 30, 2015.

"VSKIN Technology", pamphlet provided in 2012 at an ISPO conference in Munich, Germany (admitted prior art).

* cited by examiner

BRA INCORPORATING SHAPE MEMORY POLYMERS AND METHOD OF MANUFACTURE THEREOF

CROSS-REFERENCE TO RELATED APPLICATIONS

The present application claims the benefit of U.S. Provisional Application Ser. No. 62/036,723, filed Aug. 13, 2014, and of U.S. Provisional Application Ser. No. 62/116,081, filed Feb. 13, 2015, both of which are hereby incorporated by reference herein.

FIELD

The present application relates to bras that are to be worn while engaged in athletic activities.

BACKGROUND

Many sports bras are designed to limit or prevent movement of a wearer's breasts while she is engaged in athletic activity. During high impact activities, a woman's breasts do not move up and down together, but rather separately, in what can be called a "butterfly" motion. This movement of the breasts is very painful and possibly damaging to the supportive breast tissue. Currently, the common ways of supporting the breasts during athletic activity and controlling this butterfly motion are by high compression fabric, components, and construction; rigid fabric and components; and/or encapsulation of the breasts via separate breast cups, usually requiring a molded pad with or without an underwire, and usually requiring two individual cups that surround each breast, keeping, them separate.

Constructing a garment using the above-mentioned material and methods results in a tight and uncomfortable fit for the wearer; however, women who require a supportive garment to reduce breast movement during high impact exercise have no choice but to wear a similarly-constructed garment or multiple support garments to meet their breast support needs. For more information regarding breast discomfort during physical activity, and the detrimental effects thereof, please see An Abstract of the Thesis "Breast Support for the Active Woman: Relationship to 3D Kinematics of Running," by Ann L. C. Boschma, submitted to Oregon State University on Sep. 23, 1994. Boschma summarizes her study of running kinematics with the following observation: while exercising, women of all breast sizes experience increases in breast discomfort as breast support decreases. This indicates that full support bras are more comfortable for a wearer engaged in vigorous athletic activities, no matter what her breast size.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example of the present disclosure, a front panel for a sports bra includes an interior liner layer having a back face contacting a wearer's skin, and having a size and shape configured to substantially cover a wearer's breasts. An exterior shell layer having a back face facing a front face of the interior liner layer, and also having a size and shape configured to substantially cover the wearer's breasts, is coupled to the interior liner layer. A film layer is located between the front face of the interior liner layer and the back face of the exterior shell layer. When the front panel is worn as part of the sports bra, the film layer is configured to stiffen as a frequency of movement of the wearer's breasts increases, thereby absorbing forces caused by the movement of the wearer's breasts.

In another example, a method for constructing a front panel for a sports bra that stiffens upon movement of a wearer's breasts is disclosed. The method includes providing an exterior shell layer having a size and shape configured to substantially cover the wearer's breasts, and providing an interior liner layer having a back face for contacting a wearer's skin and also having a size and shape configured to substantially cover the wearer's breasts. A film layer is provided and placed between a back face of the exterior shell layer and a front face of the interior liner layer. The film layer, the exterior shell layer, and the interior liner layer are then coupled together. The film layer comprises a thermally-induced shape memory polymer that exhibits viscoelastic properties when at body temperature and stiffens to absorb between about 0.015 N and about 0.03 N of force at frequencies of breast movement of between about 6 Hz and about 15 Hz.

BRIEF DESCRIPTION OF THE DRAWINGS

Examples of articles of manufacture and methods for manufacturing bras and materials that can be used to construct bras are described with reference to the following figures. These same numbers are used throughout the figures to reference like features and like components.

DETAILED DESCRIPTION

Figure 1:
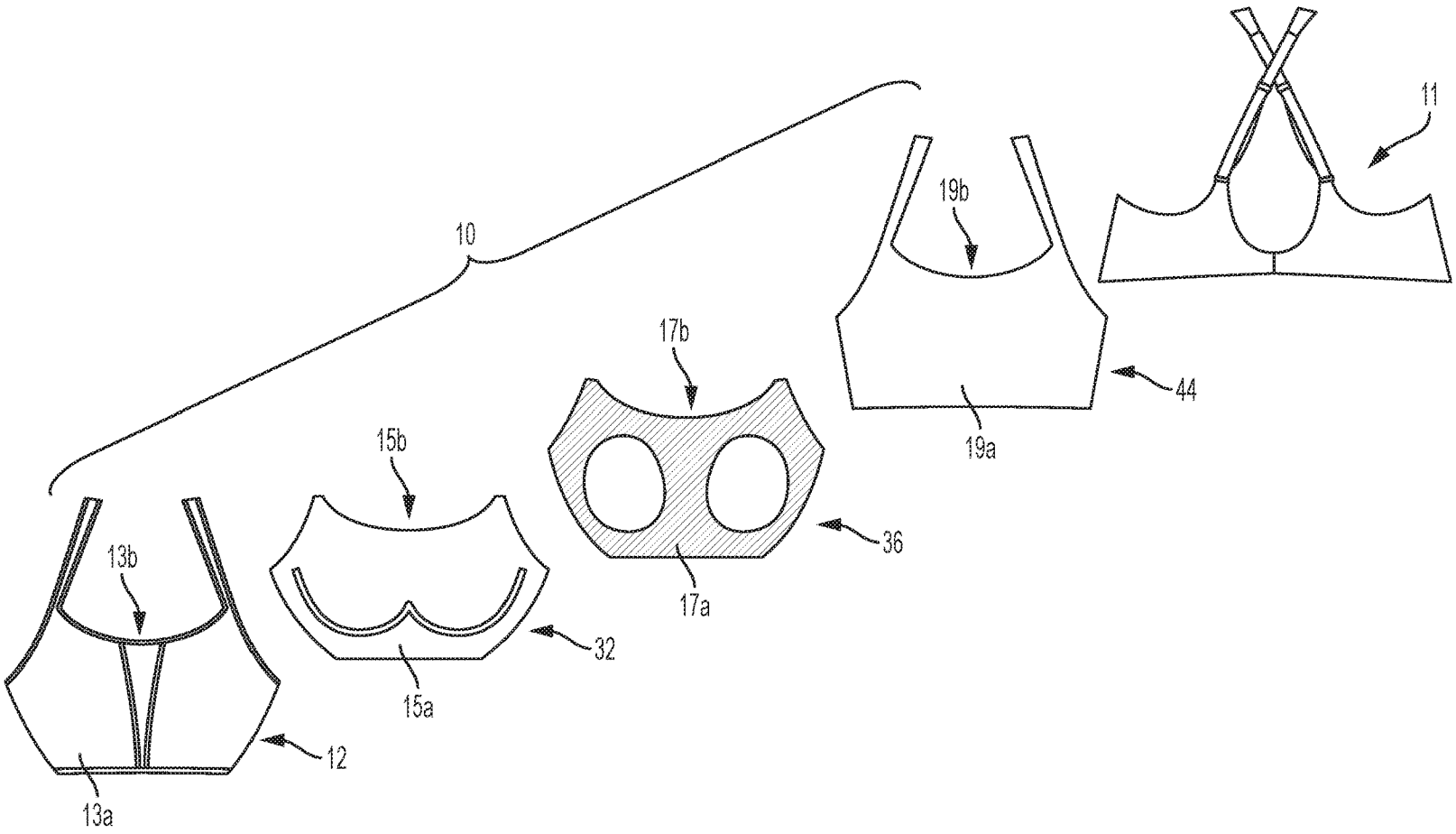
FIG. 1 shows several separated layers of a sports bra according to the present disclosure.

FIG. 1 shows several separated layers of a sports bra according to the present disclosure. These layers include an exterior shell layer 12 having a front face 13*a* and a back face 13*b*. After the bra is assembled the front face 13*a* will be visible while the bra is being worn, while the back face 13*b* will be hidden by additional layers about to be described. Adjacent the exterior shell layer 12 is an internal fabric layer 32, having, a front face 15*a* and a back face 15*b*. When the bra is assembled, the front face 15*a* of the internal fabric layer 32 laces the back face 13*b* of the exterior shell layer 12. Adjacent the internal fabric layer is a film layer 36 having a front face 17*a* and a back face 17*b*. The front face 17*a* of the film layer 36 faces the back face 15*b* of the internal fabric layer 32. Next, adjacent to the film layer 36, is an interior liner layer 44 having a front face 19*a* and a back face 19*b*. The front face 19*a* of the interior liner layer 44 faces the back face 17*b* of the film layer 36. The back face 19*b* of the interior liner layer 44 touches the wearer's skin, and is therefore the innermost part of the bra. Together, the exterior shell layer 12, the internal fabric layer 32, the film layer 36, and the interior liner layer 44 make up a front panel 10 for the bra. A rear portion 11 of the bra is shown in FIG. 1 as well. The rear portion 11 may have some or all of the same layers 12, 32, 36, 44 of material as the front panel 10, but its layers will not be described in detail herein. Rather, focus will be on describing the front panel 10 and its superior bounce-absorbing capabilities.

Figure 2:
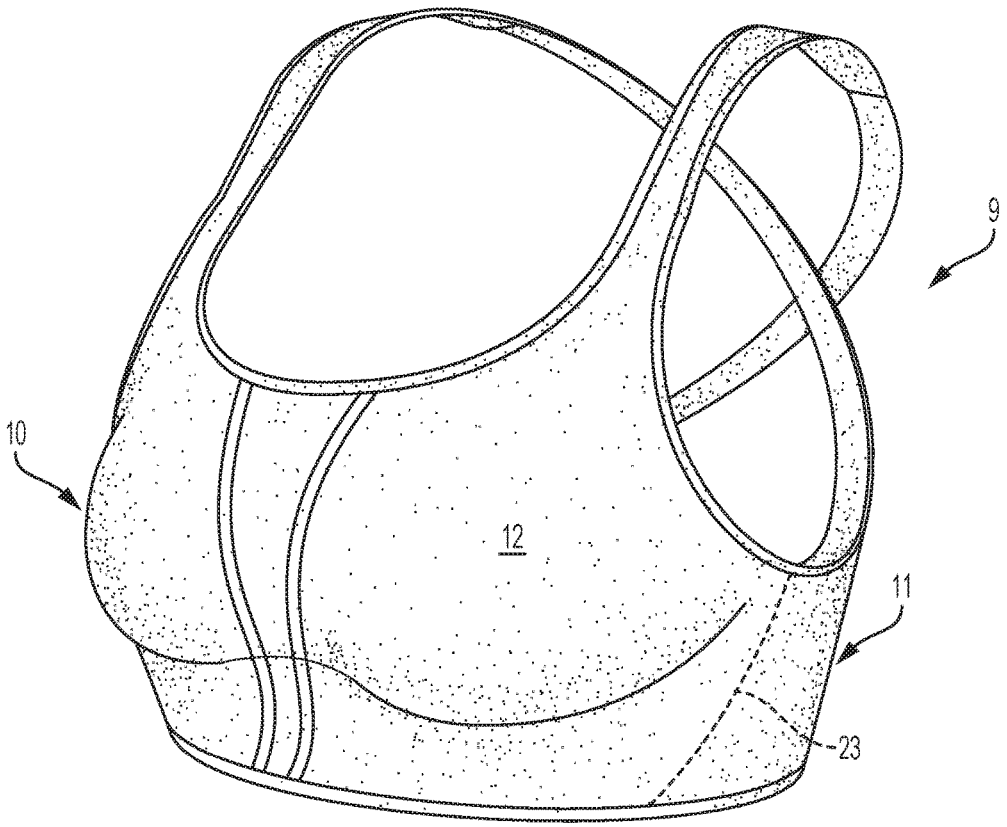
FIG. 2 shows the several layers combined into a sports bra according to the present disclosure.

FIG. 2 shows a sports bra 9 according to the present disclosure, with all of the layers 12, 32, 36, 44 of the front panel 10 and the rear portion 11 assembled together. FIG. 2 shows how the rear portion 11 and the front panel 10 can be sewn or otherwise coupled to one another along a seam 23, it being understood that a similar seam may exist on the opposite side of the bra 9. Further details of the connection of the from panel 10 to the rear portion 11 of the bra 9 will be described herein below. It should be understood that the rear portion 11 and the front panel 10 are connected such that the wearer's body is situated between the rear portion 11 and the interior liner layer 44 of the front panel 10 when the bra 9 is being worn.

Figure 3:
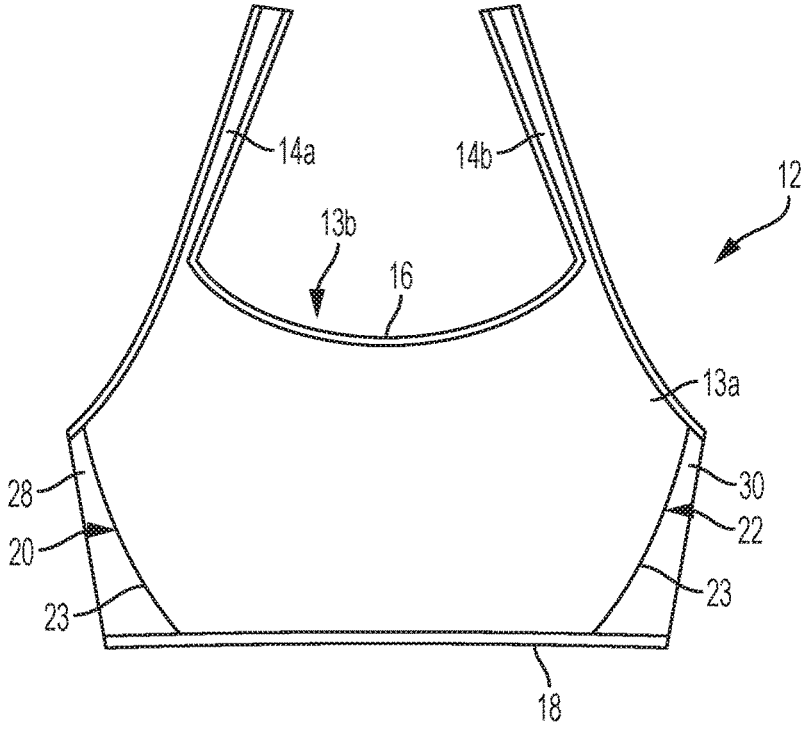
FIG. 3 shows an exterior shell layer of a front panel for the sports bra.

FIG. 3 illustrates the exterior shell layer 12 for the front panel 10 for the sports bra 9. The front (exterior) face 13*a* of the exterior shell layer 12 is shown. The exterior shell layer 12 is the layer one would normally see facing outwardly from a wearer's body while the bra 9 is being worn. The back face 13*b* (opposite side) of the exterior shell layer 12 is closer to the wearer's body than the front face 13*a*. The exterior shell layer 12 may comprise a piece of fabric having a size and shape configured to substantially cover a wearer's breasts, and may have two straps 14*a*, 14*b* extending therefrom. The exterior shell layer 12 can be a fabric made of nylon, spandex, polyester, polypropylene, or any combination of these with one another or with cotton. In one example, the exterior shell layer 12 is a 320 gram fabric with a tight knit that provides compression to the wearer's breasts. The exterior shell layer 12 has a neckline 16, a rib cage band 18, a left side 20, and a right side 22. The straps 14*a*, 14*b* extend from an upper edge of the exterior shell layer 12 near the neckline 16. The straps 14*a*, 14*b* can be integral with the exterior shell layer 12, or can be separately sewn or otherwise coupled to the exterior shell layer 12. In one example, the straps 14*a*, 14*b* are padded. The exterior shell layer 12 may be sewn or otherwise coupled along scams 23 to other layers of the front panel 10, as well as to the rear portion 11, as will be described further herein below.

Figure 4:
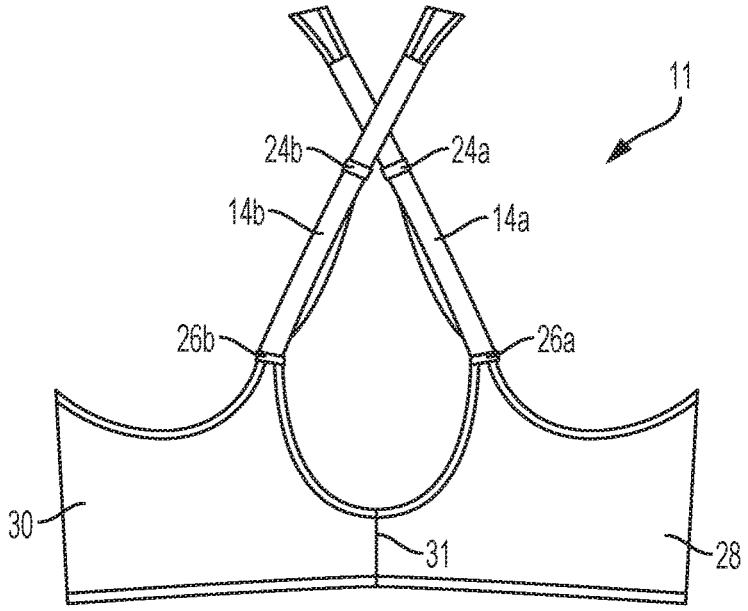
FIG. 4 shows a rear portion of the sports bra.

FIG. 4 shows a rear portion 11 of the sports bra 9, which was not fully shown in FIG. 3 for the sake of clarity. More specifically, FIG. 4 shows an exterior of the rear portion 11 of the bra 9, which would be seen during, normal wear of the bra. The interior of the rear portion 11 (i.e., the part that contacts the wearer) is on the side opposite that shown in FIG. 4. For the sake of clearly illustrating the rear portion 11 of the bra, the rear portion 11 is not shown connected to the front panel 10. However, if should be understood that the rear portion 11 could be integral with, sewn, or otherwise coupled to the front panel 10 when the bra 9 is fully assembled, as will be described further below. FIG. 4 shows how the straps 14*a*, 14*b* (which can be integral with, sewn, or otherwise coupled to the straps 14*a*, 14*b* shown in FIG. 3) can be crossed over one another in order to create an X-shaped back. In other embodiments, the straps can form a U-shape, a V-shape, or a T-shape (racer back) and need not cross over one another. The orientation and/or shape of the straps is therefore not limiting on the scope of the present disclosure. The straps 14*a*, 14*b* may be provided with sliders 24*a*, 24*b* that allow the length of the straps 14*a*, 14*b* to be adjusted.

Straps 14*a*, 14*b* are attached to an upper portion of the back of the bra 9 via rings 26*a*, 26*b*, which also allow for adjustment of the lengths of the straps. Straps 14*a*, 14*b* are connected by rings 26*a*, 26*b* respectively to wings 28, 30. Wings 28, 30 may be connected to one another at location 31 by a hook and eye closure, or by any other closure known to those having ordinary skill in the art, such as by snaps, Velcro, magnetic closures, etc. When the bra 9 is fully assembled, wing 28 extends from left side 20 of the exterior shell layer 12 and wing 30 extends from right side 22 of the exterior shell layer 12 (see FIG. 3, where wings 28, 30 are shown wrapping around the lateral sides of the bra and connected to the front panel 10 at seams 23). The wings 28, 30 may be integral with or sewn to the left and right sides 20, 22 of the exterior shell layer 12, such as for example along seams 23. In alternative embodiments, Bemis tape, ultrasonic seams, and/or glue could be used instead of sewing at seams 23. The exterior fabric of the wings 28, 30 may be the same fabric, as that of the exterior shell layer 12.

Figure 5:
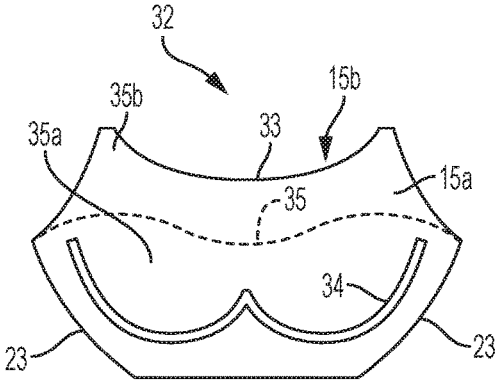
FIG. 5 shows an internal fabric layer of the front panel.

Turning to FIG. 5, and proceeding inwardly from the exterior shell layer 12 toward the wearer's breasts, the next layer of the front panel 10 of the bra 9 is an internal fabric layer 32. A front face 15*a* of the internal fabric layer 32 is shown in FIG. 5, and when assembled, faces the back face 13*b* of the exterior shell layer 12. The opposite, back face 15*b* is thus closer to the wearer's skin. The internal fabric layer 32 may end at an upper edge 33 approximately where the straps 14*a*, 14*b* of the exterior shell layer 12 would start, or may continue along the straps 14*a*, 14*b*. The internal fabric layer 32 may be sewn (or otherwise connected) to the exterior shell layer 12 along seams 23. Note that where these seams 23 are shown is also approximately where the lateral edges of the internal fabric layer 32 are located. In one example, the internal fabric layer 32 may comprise a knitted spacer fabric that provides breathability, comfort, and modesty to the wearer. In another example, the internal fabric layer 32 may comprise two different types of fabric: a first fabric 35*a* below dashed line 35 comprising a knitted spacer fabric, and a second fabric 35*b* above dashed line 35 comprising a mesh fabric. The mesh fabric 35*b* acts as a stabilizer and reduces the thickness of the front panel 10 in the areas where it is used, as it is much thinner than the knitted spacer fabric.

In one example, an underwire 34 may be coupled to the internal fabric layer 32. For example, the underwire 34 may be a plastic underwire that is surrounded by an underwire runnel casing. The underwire tunnel casing may be sewn along its edges to the internal fabric layer 32. The tunnel casing may additionally or alternatively be glued, bonded, or taped to the internal fabric layer 32, or the underwire 34 itself maybe glued or taped to the internal fabric layer 32. The underwire 34 may comprise a continuous, undulating W shape, or may comprise two separate U-shaped underwires, although these are not shown herein. Each of the weight, thickness, and shape of the underwire 34 may be customized by cup size to provide the required support level. The underwire 34 may be sewn to the front face 15*a* of the internal fabric layer 32 such that the springiness of the spacer fabric between the underwire 34 and the wearer's skin protects the wearer from the relative rigidity of the underwire 34.

Figure 6:
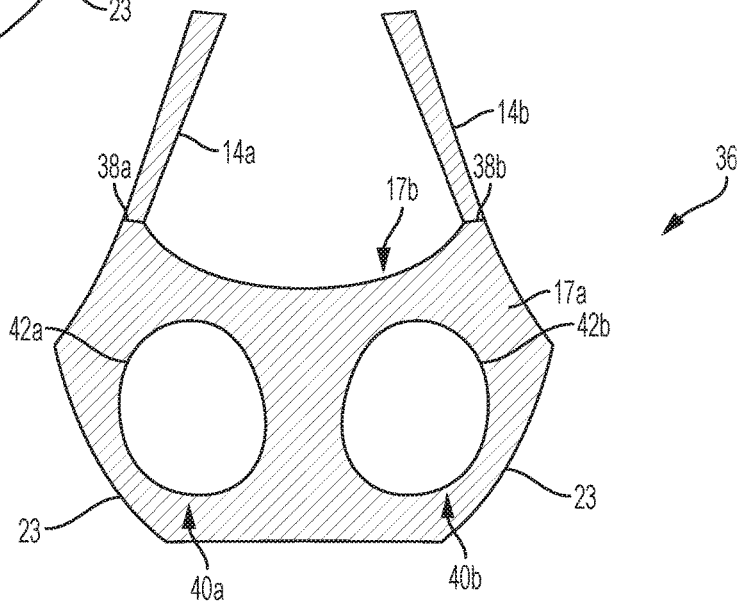
FIG. 6 shows a film layer to be located between an interior liner layer and the exterior shell layer.

Again, continuing inwardly from the internal fabric layer 32 towards the wearer's breasts, as shown in FIG. 6, the front panel 10 further comprises a film layer 36, shown in hatching. The front face 17*a* of the film layer 36 faces the back face 15*b* of the internal fabric layer 32 shown in FIG. 5. The back face 17*b* is on the opposite side from that shown and is closer to the wearer's body. The film layer 36 may continue up into the straps 14*a*, 14*b* as shown herein, or may end at the lines 38*a*, 38*b* shown in FIG. 5. In the either case, the film layer 36 may be sewn to the internal fabric layer 32 and/or to the exterior shell layer 12. The film layer 36 comprises a first breast cup 40*a* and a second breast cup 40*b*. The film layer 36 has a first aperture 42*a* at an apex of the first breast cup 40*a* and a second aperture 42*b* at an apex of the second breast cup 40*b*. The first and second apertures 42*a*, 42*b* allow a wearer's breast tissue to project there through, thereby providing spaces for the breast tissue to fill. The film layer 36 is not very stretchy and might not expand to provide enough room for the breast tissue, but the internal fabric layer 32 and even the compression fabric of the exterior shell layer 12 beyond the apertures 42*a*, 42*b* provide enough stretch to accommodate the wearer's breast tissue.

Thus, the apertures 42*a*, 42*b* allow the volume of the user's breasts to fit within the front panel 10 despite the non-stretchy film layer 36. Generally, the apertures 42*a*, 42*b* may be sized to allow a substantial portion of the wearer's breast tissue to project there through, and in one example about 50% of a wearer's breast tissue projects through the apertures 42*a*, 42*b*, if these apertures 42*a*, 42*b* were not provided, some sort of puckering, folding, or gathering of the material of the film layer 36 could instead be provided in order to fit the volume of the wearer's breasts within the first and second breast cups 40*a*, 40*b* In the example shown, the film layer 36 comprises a single sheet having two apertures 42*a*, 42*b*; however, the film layer 36 could comprise multiple sheets sewn or otherwise connected together. As shown herein, film layer 36 is sewn or otherwise connected along seams 23 to exterior shell, layer 12, which are the same seams along which internal fabric layer 32 is sewn to exterior shell layer 12. Note that where these seams 23 are provided is also roughly where the film layer's lateral edges are located.

The film layer 36 may be molded such that the first and second breast cups 40*a*, 40*b* have a concave shape that approximates a shape of the wearer's breasts and that is predetermined based on breast size. The convex exterior of the bra shown in FIG. 2 reflects the opposite side of the concave shape of the breast cups 40*a*, 40*b*. The concavity of the breast cups 40*a*, 40*b* allows the material of the film layer 36 to fit closely along the shape of the wearer's breasts and ensures that some of the volume of the wearer's breasts may project through the apertures 42*a*, 42*b*, The apertures may also be sized specifically based on the bra's cup size, such that larger apertures 42*a*, 42*b* are provided for larger cup sizes, and vice versa. The circumference of each aperture 42*a*, 42*b* may be heat-treated in order to provide strength to this area and hold the shape of the aperture. The material of which the film layer 36 is made will be more fully described herein below.

Figure 7:
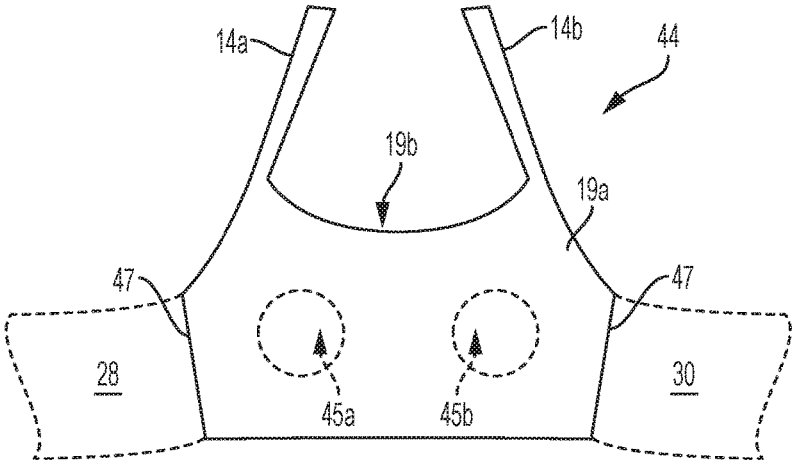
FIG. 7 shows the interior liner layer for contacting a wearer's skin.

Now turning to FIG. 7, and again continuing through the layers of the front panel 10 as they move closer towards the wearer's breasts, an interior liner layer 44 of the front panel 10 will be described. The front face 19*a* of the interior liner layer 44 faces the back face 17*b* of the film layer 36 shown in FIG. 6. The back face 19*b* (i.e., the face that actually touches the wearer's skin) is on the opposite side from that shown in FIG. 7. The interior liner layer 44 may be a sheet of fabric that has straps (in one example, co-extensive with straps 14*a*, 14*b* of exterior shell layer 12) extending integrally therefrom, a sheet of material that does not include straps, or a sheet of material that includes straps that are sewn to its upper edges. The interior liner layer 44 may comprise fabric made of spandex, nylon, polyester, or any blend of one of those materials with one another and/or with cotton. The interior liner layer 44 may alternatively comprise a polypropylene-spandex blend. When the bra 9 is worn, the back face 19*b* of the interior liner layer 44 sits against the wearer's skin. In one example, the interior liner layer 44 ends at the lateral edges 47 shown in FIG. 7. Preferably, however, the interior liner layer 44 extends continuously from the front panel portion shown in FIG. 7 out to form the interior faces of the wings 28, 30 on the rear portion 11 of the bra 9, as partially shown in dashed lines (see also FIG. 4). For example, the interior liner layer 44 may comprise one seamless sheet of material that extends across the back farce of the entire front panel 10 and along the inside surfaces of the wings 28, 30 (i.e., the surfaces that touches the wearer's body) to the location 31 where the wings 28, 30 are intended to meet. In both cases, the interior liner layer 44 has a size and shape configured to substantially cover a wearer's breasts.

The interior liner layer 44 may also be molded such that it has first and second breast cups 45*a*, 45*b* that have a concave shape and that fit the size of a wearer's breasts. These cups 45*a*, 45*b*, when a wearer's breasts are not in them, appear as somewhat wrinkled or looser areas in the fabric, of the interior liner layer 44, which then stretch to encapsulate the wearer's breasts when the bra 9 is worn. It should be understood that when the wearer's breasts are described as at least partially extending through the apertures 42*a*, 42*b* in the film layer 36, the wearer's breasts are in fact resting in the breast cups 45*a*, 45*b* of the interior liner layer 44, and both the wearer's breasts and the fabric of the breast cups 45*a*, 45*b* project through the apertures 42*a*, 42*b*, respectively. The interior liner layer 44 thus provides a smooth surface for contacting the wearer's skin, as well as a barrier between the wearer's breasts and the film layer 36, such that the wearer does not notice that her breasts are projecting through the apertures 42*a*, 42*b*.

Figure 8:
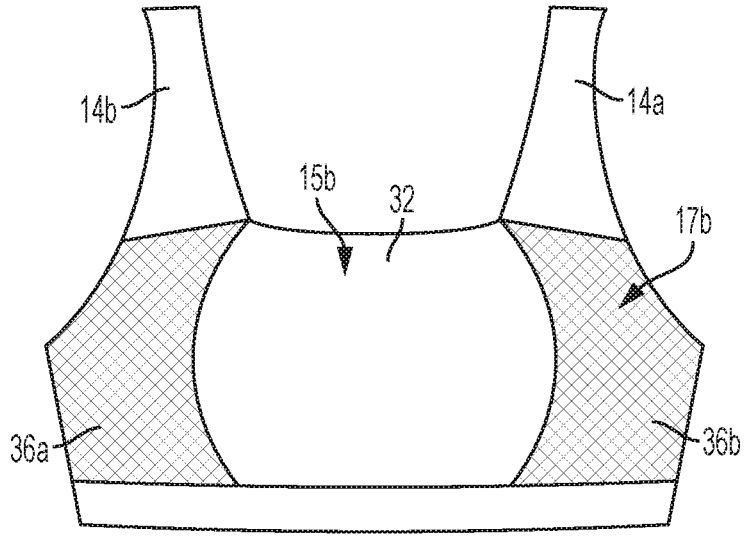
FIGS. 8 and 9 show alternative examples of the film layer.
Figure 9:
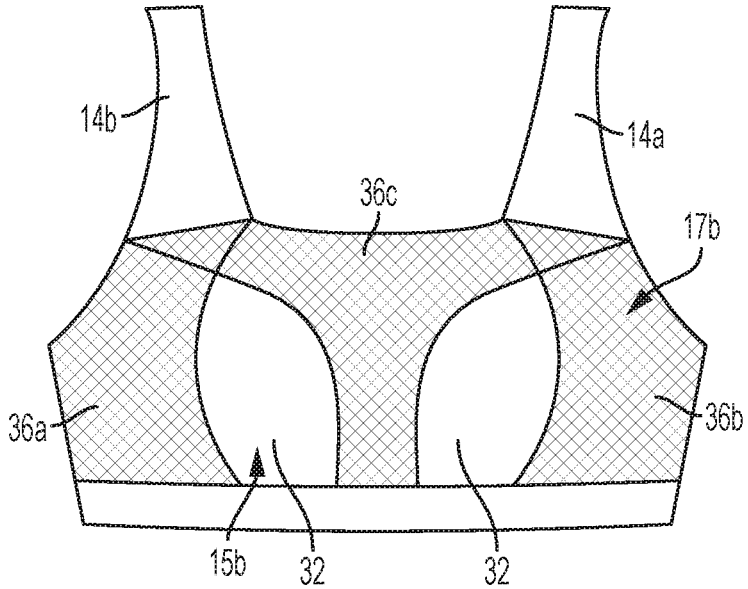

Now turning to FIGS. 8 and 9, alternative configurations for the film layer 36 are shown. Here, the film layer 36 and internal fabric layer 32 are shown from their back faces 15*b*, 17*b*, respectively, so as to show how the pattern and coverage of the film layer 36 compare to that of the internal fabric layer 32. As shown in FIG. 8, the film layer 36 may comprise two separate sheets 36*a*, 36*b* that are sewn to the back face 15*b* of the internal fabric layer 32. Alternatively, these sheets 36*a*, 36*b* may be sewn directly to the back face 13*b* of the exterior shell layer 12 or to the front face 19*a* of the interior liner layer 44, if no internal fabric layer 32 is provided. When the bra 9 is worn, the sheets 36*a*, 36*b* are provided near laterally exterior sides of the wearer's breasts, but do not extend much above, below, or between the wearer's breasts. In contrast, as shown in FIG. 9, a third sheet 36*c* is provided along with the sheets 36*a*, 36*b*. This sheet 36*c* is generally T-shaped and when the bra is worn does extend between the wearer's breasts. However, the film material does not extend much beneath the wearer's breasts. In contrast to the examples of FIGS. 8 and 9, the film layer 36 shown in FIG. 6 extends completely around the wearer's breasts and has apertures 42*a*, 42*b* that allow a portion of the wearer's breasts to extend there through. This ensures that a full circumference of each of the wearer's breasts is surrounded by the film layer 36, in order to reap the below-described force-absorbing benefits thereof. This also ensures that both upward and downward forces from bouncing breasts are absorbed, as well as side-to-side bounce, all experienced during the above-mentioned butterfly motion of breasts while a woman is exercising.

In any of the examples of FIGS. 6, 8, and 9, the film layer 36 may be included in several different ways. The film layer 36 may be a separate layer of material that is formed as a mesh a layer of fabric with holes in it). Alternatively, the film layer 36 may be a resin layer printed on or otherwise molded or adhered to another layer of fabric made of natural, synthetic, or a blend of natural and synthetic fibers (i.e., the film layer 36 may be a resin layer covering part of the surface of at least one side of the other fabric). In yet another example, the film layer 36 may be a resin layer printed onto the back face 13*b* of the exterior shell layer 12, the back face 15*b* of the internal fabric layer 32, or the front face 19*a* of the interior liner layer 44.

According to the present disclosure, the material of which the film layer 36 is made becomes stiffer as a frequency of movement of a wearer's breasts increases, and thereby absorbs forces caused by the movement of the wearer's breasts. This is important because, as the frequency of a wearer's breasts increases (from moderate to strenuous exercise) the force caused by acceleration of the breasts also increases. This increasing force can be absorbed by the film layer 36 of the present disclosure, which is made of a shape-memory polymer (SMP). According to the present disclosure, the film layer 36 may comprise a thermally-induced SMP that exhibits viscoelastic properties when at or near the temperature of the human body. In other words, the SMP's glass transition temperature is at or near body temperature. The SMP stiffens to absorb energy at frequencies of breast movement between about 1 Hz and about 100 Hz and is capable of effectively absorbing forces up to and above 0.03 N, as will be described further herein below. At or near body temperature, the SMPs described herein are able to provide damping to the movement of the wearer's breasts, as they also exhibit a high energy dissipation factor (tan δ) at higher frequencies, yet maintain a good skin feel at lower frequencies, where the tan δ is also lower. Additionally, given a constant frequency, tan δ is at a maximum in the range of the temperature of the human body, and thus the SMPs described herein are particularly suited for applications in clothing.

In one example, the polymer from which the SMP fabric is constructed may include polyurethane elastomer resin and polystyrene elastomer resin blended, for example, in a ratio of 9:1. In another example, the polymer is a blend of thermoplastic polyurethane and thermoplastic polyurethane-silicone elastomer (made by a dynamic vulcanization process), combined, for example, at a mass ratio of 90:10 to 60:40. In still other examples, parts or all of the film layer 36 are made of 100% silicone, or 100% thermoplastic polyurethane (TPU), such as DESMOPAN® Developmental Product DP 2795A-SMP provided by Bayer Material Science of Pittsburgh, PN.

In another example, described in Japanese Patent Application No. 2015-17206, filed on Jan. 30, 2015 by SMP Technologies, Inc. of Tokyo, Japan and by inventor Dr. Shunichi Hayashi, and published as JP 2016-141709 A, and hereby incorporated herein by reference, the SMP film layer 36 may comprise a polyurethane elastomer produced by the polymerization of a bifunctional diisocyanate, bifunctional polyol and bifunctional chain extender using the pre-polymer method or bulk method at a molar ratio of 2.00-1.10:1.00:1.00-0.10, and may have multiple apertures at an aperture ratio ranging from 10-90% (inclusive). The molecular weight of the bifunctional diisocyanate can range from 174 to 303, the molecular weight of the bifunctional polyol can range from 300 to 2,500, and the bifunctional chain extender can be a diol or diamine with a molecular weight ranging from 60 to 360. The number of apertures in the film per unit area can range from 30/cm$^2$ to 150/cm$^2$ (inclusive). Specific examples of the bifunctional diisocyanate include 2,4-toluene diisocyanate, 4,4'-diphenyl methane diisocyanate, carbodiimide-modified 4,4'-diphenylmethane diisocyanate and hexamethylene diisocyanate. Specific examples of the bifunctional polyol include polypropylene glycol, 1,4-butane glycol adipate, polytetramethylene glycol, polyethylene glycol, and propylene oxide adducts of bisphenol-A. The bifunctional polyol can also be further modified by reacting it with a bifunctional carboxyllic acid or cyclic ether. Examples of the diols which can be used include ethylene glycol, 1,4-butane glycol, bis (2-hydroxyethyl) hydroquinone, ethylene oxide adducts of bisphenol-A and propylene oxide adducts of bisphenol-A. Examples of the diamines which can be used include ethylene diamine. The glass-transition temperature of the film should fall within a range of 0 to 40° C., with a range of 25 to 35° C. preferable.

Figure 10:
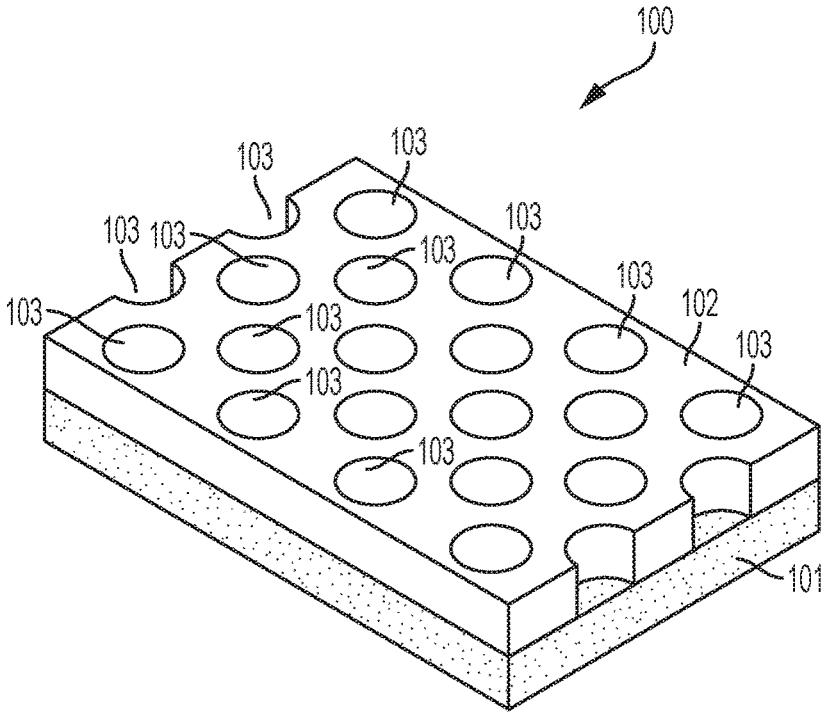
FIG. 10 shows one example of a construction of the film layer.
Figure 11:
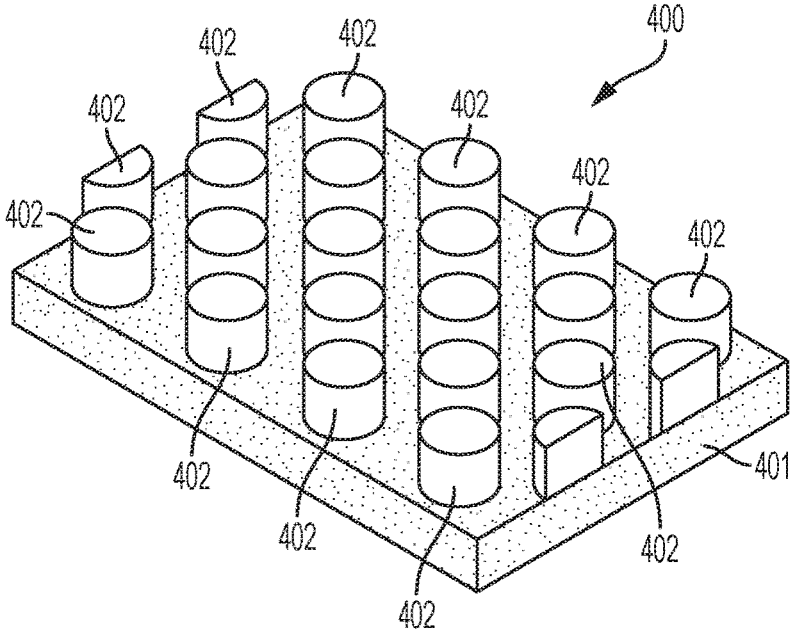
FIG. 11 shows another example of a construction of the film layer.

In another example, the film layer 36 is a composite fabric including a fabric produced from natural fiber, synthetic fiber or a mixed fiber containing both natural fiber and synthetic fiber, as well as a synthetic resin layer which covers part of the surface of at least one side of the fabric. The synthetic resin layer is composed primarily of the above-mentioned polyurethane elastomer, and the coverage ratio of the synthetic resin layer relative to the surface of the fabric ranges from 10 to 90% (inclusive). For example, see FIG. 10, which shows film layer 100 having a fabric layer 101 coated with a resin layer 102 having apertures 103 extending there through. These apertures 103 are shown as being cylindrical, but they could take any shape, such as but not limited to hexagons, ellipses, polygons, or rounded polygons. In other examples, the fabric layer 101 is coated on both sides with the resin layer 102. In FIG. 10, the resin layer 102 is a continuous sheet having apertures 103. In other examples, the resin layer 102 is split into two or more sheets with gaps left there between. In still other examples, referring to FIG. 11, the film layer 400 comprises a fabric layer 401 with the resin layer 402 applied in discontinuous or discrete dots (or other shapes).

If the synthetic resin layer is a continuous film containing, apertures, the aperture ratio of the synthetic resin layer ranges from 10 to 90% (inclusive), or more specifically from 20 to 50% (inclusive). The number of apertures per unit area ranges from 30/cm$^2$ to 150/cm$^2$ (inclusive). The thickness of the synthetic resin layer ranges from 20 to 1,000 μm (inclusive).

Example 1

For Example 1, a film was formed over a release sheet using gravure printing and the release sheet was applied to a fabric to prepare the composite fabric detailed below.

Fabric: PET fabric, 75 D×100 D (denier) (84 T×100 T (decitex))

Fabric Size: 1530 mm by 1000 mm

Synthetic Resin Layer Composition: SMPMM-2520 manufactured by SMP Technologies Co., Ltd.

Synthetic Resin Layer Size: Continuous film 150 mm by 1,000 mm in size

Synthetic Resin Layer Thickness: 200 μm

Aperture Ratio: 25%

Number of Apertures per Unit Area: 74.4/cm$^2$ (480 inch$^2$)

In order to demonstrate the superiority of the shape Memory polymers described herein and of fabric/SMP composites over materials generally used to construct front panels of sports bras, FIGS. 12-15 will now be discussed.

FIGS. 12-15 show the graphical results of dynamic mechanical analysis (DMA) of several test materials. DMA measures the mechanical properties of tested materials as a function of time, temperature, and frequency. The type of DMA performed on the materials shown in FIGS. 12-15 is known as a frequency sweep, in which a sample material is held at a fixed temperature and tested at a variety of frequencies. The DMA graphs show a storage modulus, loss modulus, force, and tan δ of each of the tested materials. The storage modulus E' is measured on the left hand side of the left axis, the loss modulus E" is measured on the right hand side of the left axis, the force is measured on the left hand side of the right axis, and the mechanical dynamic loss tangent (tan δ) is measured on the right hand side of the right axis. The storage modulus measures the ability of the material to store energy (i.e., the elastic portion) and the loss modulus measures the ability of the material to dissipate energy as heat (i.e., the viscous portion). The x-axis shows the frequency of the material being tested in Hz. The DMA machine used for these tests was the Q800 Version 20.6 Build 24, provided by TA Instruments.

Figure 12:
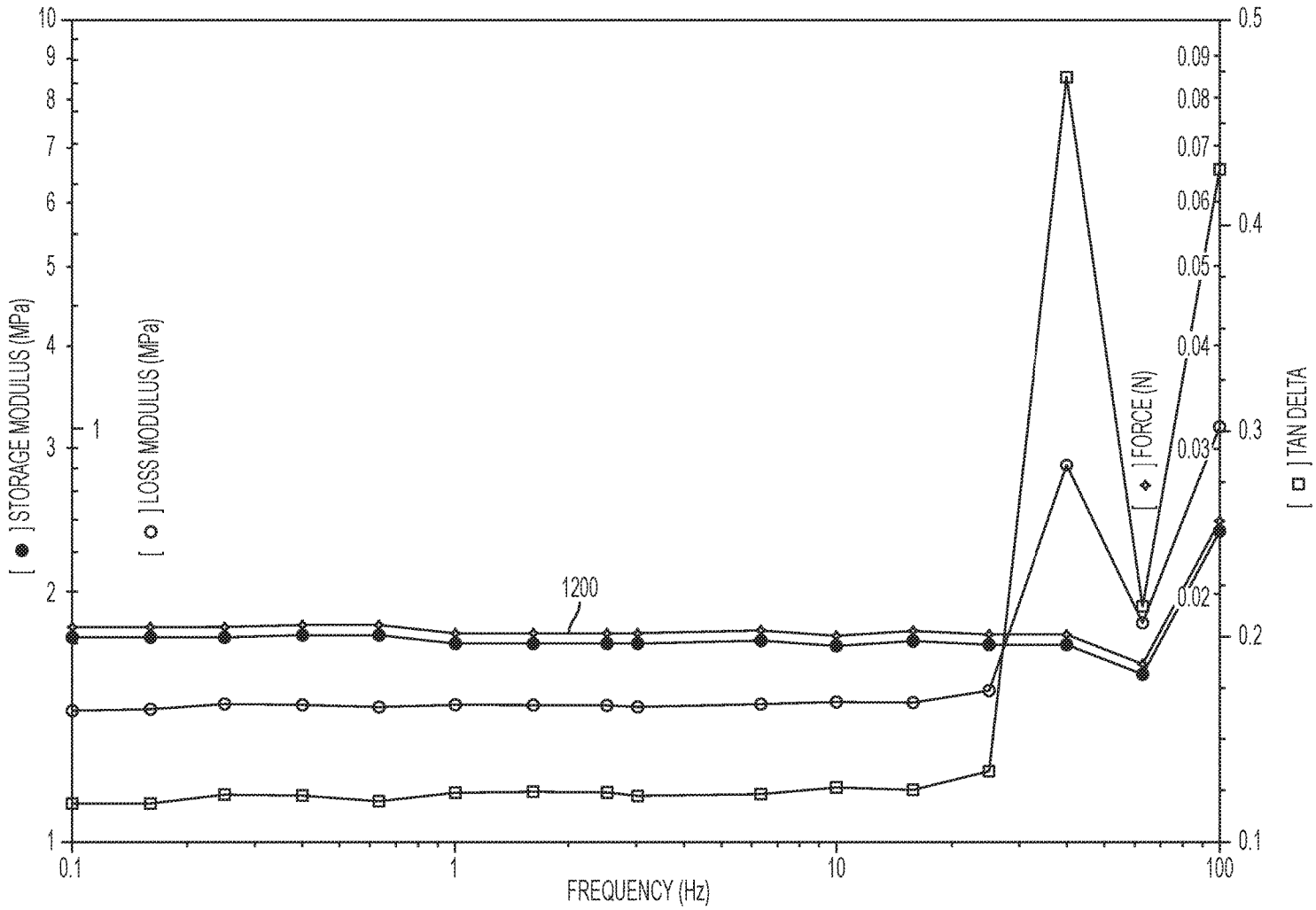
FIG. 12 is a graph showing a dynamic mechanical analysis (DMA) of a piece of fabric layered with a prior art mesh.

FIG. 12 shows a graph from a DMA of fabric layered with a prior art mesh material. As shown, the force that the layered material is able to absorb does not vary with the frequency at which the material is tested (i.e., the force plot 1200 remains relatively flat). In other words, the material is unable to stiffen to absorb increasing force of the wearer's breasts caused by increasing frequency of movement during physical activity, which generally can range from 0.1 Hz to 15 Hz.

Figure 13:
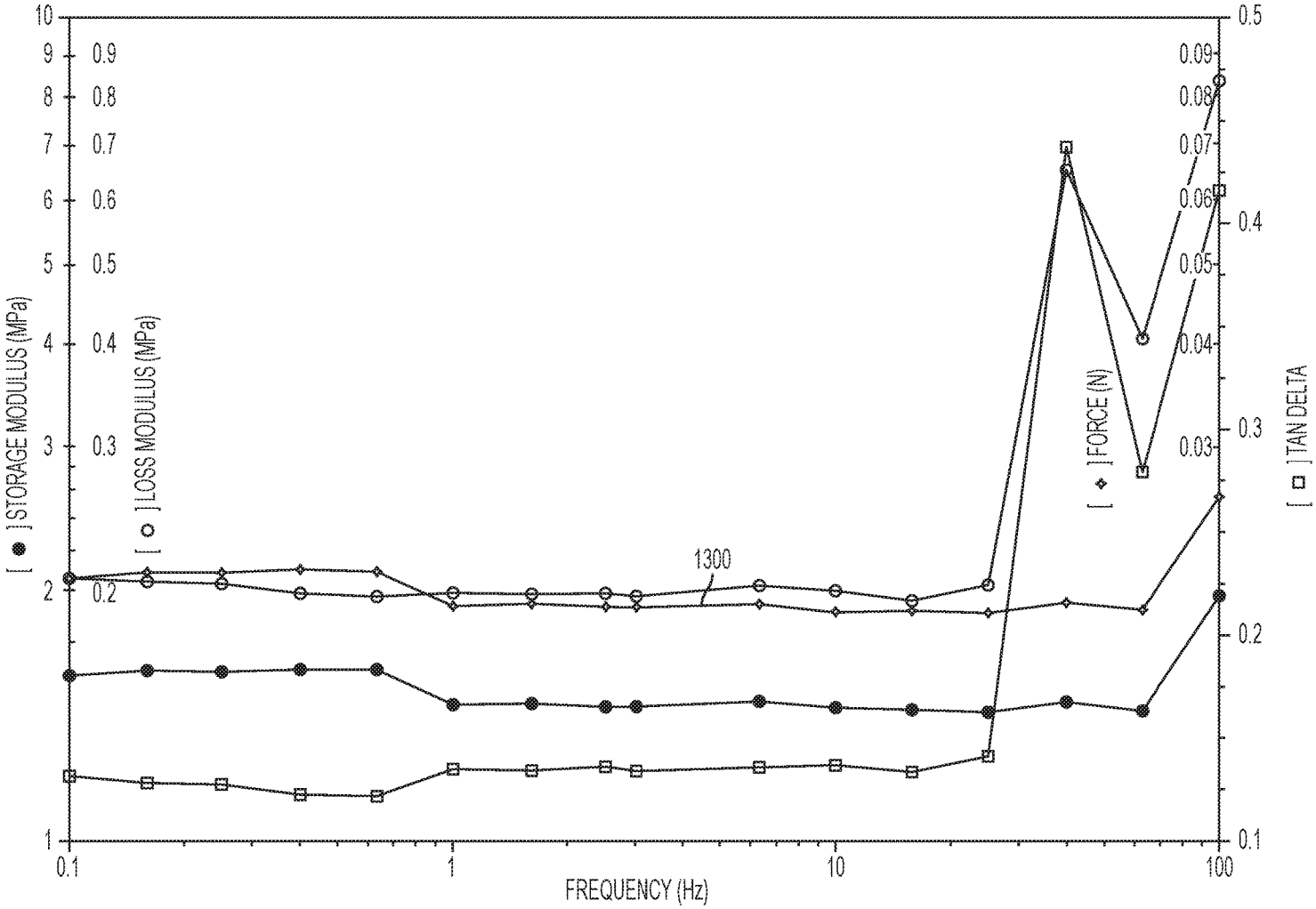
FIG. 13 is a graph showing a DMA of a 100% spandex fabric.

Turning to FIG. 13, a DMA of 100% spandex fabric is shown. As shown by the plot 1300, the force that the material is capable of absorbing remains relatively the same across all frequencies (especially in the 0.1 Hz to 15 Hz frequency range produced while exercising), again showing that the material is incapable of stiffening to absorb an increasing force of a wearer's breasts.

Figure 14:
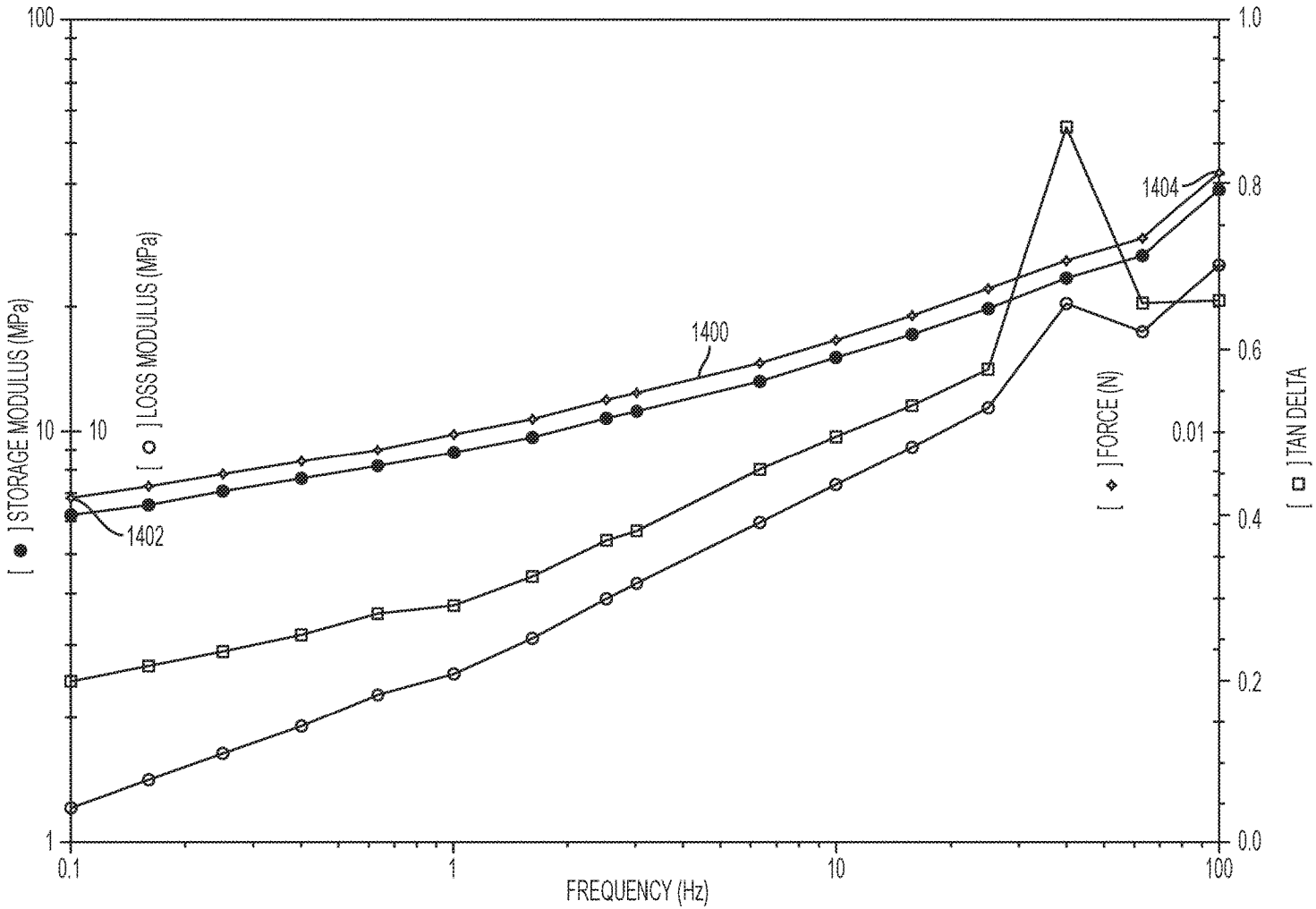
FIG. 14 is a graph showing a DMA of a film made of 100% shape memory polymer.

Turning to FIG. 14, which shows DMA of an SMP film according to the present disclosure (see Example 1), it can be seen that the amount of force that the film is capable of absorbing increases gradually as the frequency at which the material is tested increases. For example, referring to line 1400, the force that the material is able to absorb ranges from less than 0.01 N at 0.1 Hz (see point 1402) to greater than 0.8 N at 100 Hz (see point 1404). This shows that as frequency of the wearer's body increases (i.e., as the intensity of a workout increases), the SMP fabric of the current disclosure is able to absorb an increasing amount of force (i.e., bounce of the breasts).

Figure 15:
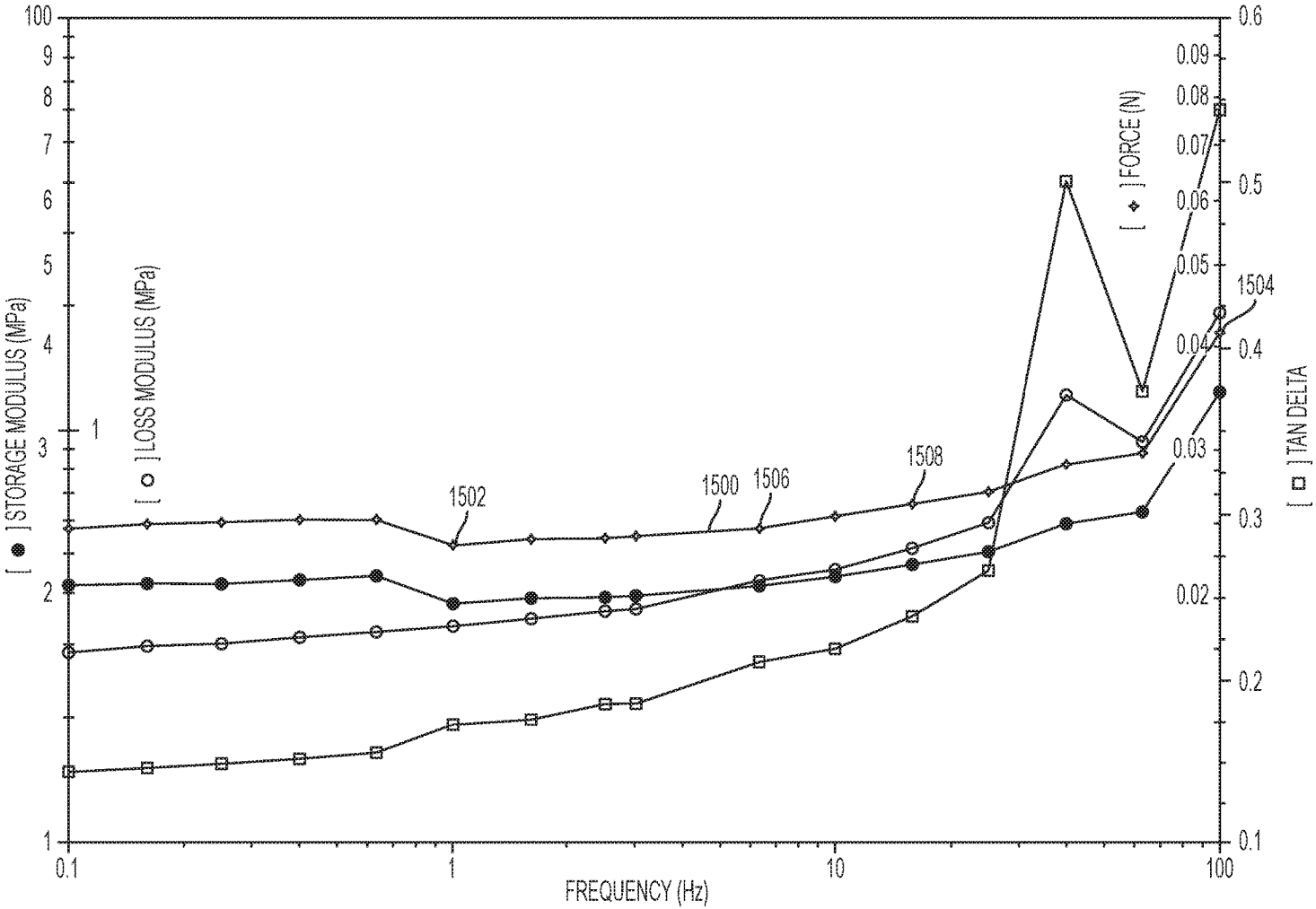
FIG. 15 is a graph showing a DMA of fabric layered with 100% shape memory polymer film.

FIG. 15 shows a graph from DMA of fabric layered with 100% SMP film according to Example 1. The test of FIG. 15 most closely corresponds to the front panel 10 of the bra 9 according to the present disclosure, as it tests fabric (e.g., exterior shell layer 12, internal fabric layer 32, interior liner layer 44), layered with 100% SMP film (e.g., film layer 36). Looking at line 1500 on the chart, it can be seen that the force that the layered construction is able to absorb increases gradually beginning at a frequency of 1 Hz (about 0.023 N at point 1502) to frequencies up to 100 Hz (about 0.041 N at point 1504). As shown in the graph, the force that the fabric layered with 100% SMP film is able to absorb includes forces of 0.03 N and higher. For a wearer who is walking, the frequency of her breast movement may be about 6 Hz. For a wearer who is vigorously exercising, the frequency of her breast movement may be about 15 Hz. At such frequencies, the layered fabric/SMP construction of the present disclosure stiffens to absorb between about 0.015 and about 0.03 N of force. More specifically, in this frequency range of 6 Hz to 15 Hz, the layered fabric/SMP construction stiffens to absorb between about 0.024 N (point 1506) and about 0.026 N (point 1508).

The efficacy of the SMP film in counteracting movement of a wearer's breasts can also be studied by measuring the storage elastic modulus and loss modulus of the SMP film. The synthetic resin constituting the synthetic resin layer described in Example 1 above shows as higher storage elastic modulus E' as well as a higher loss modulus E" at frequencies which correspond to exercise versus frequencies which correspond to a rest state. The synthetic resin layer also shows a high mechanical dynamic loss tangent (tan δ) within the frequency range of the surface of the human body (0.1 to 100 Hz).

Figure 16:
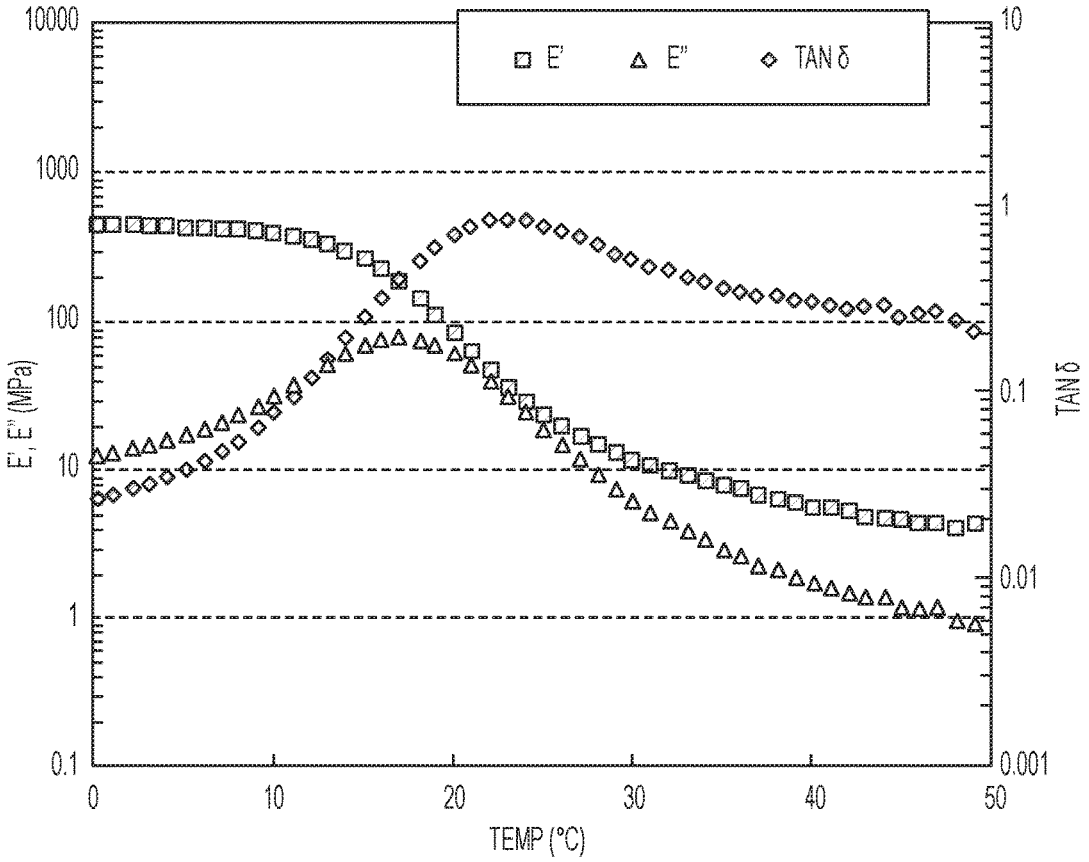
FIG. 16 is a graph showing dynamic viscoelasticity temperature dependence observed for one example of a film used in the film layer.

FIG. 16 is a graph showing dynamic viscoelasticity temperature dependence (0 to 50° C.) for a film made according to Example 1. In FIG. 16 the horizontal axis represents temperature, while the first vertical axis represents the storage elastic modulus E' and the loss modulus E" and the second vertical axis represents tan δ. Here tan δ is the tangent of the ratio of the loss modulus E" to the storage elastic modulus E' (E"/E') at a frequency of 1.0 Hz. The measurements shown in FIG. 16 were made using a viscoelasticity measuring apparatus (TA Instruments Inc., RSA-G2), Measurement conditions were as follows: measurement frequency: 1.0 Hz; temperature range: −50 to 80° C.; rate of temperature increase: 5° C./min; measurement distortion: automatically variable from 1%; initial tension: 30 g (constant). The composite fabric produced in Example 1 showed a tan δ maximum near 34° C. (Note that tan δ is generally at a maximum at/near the glass transition, where the storage modulus decreases dramatically and the loss modulus reaches a maximum.) Because the composite fabric produced in Example 1 has a glass-transition temperature within range of the surface temperature of the human body, it is particularly comfortable when worn on the human body.

Note that when only the synthetic resin layer film was measured, a dynamic viscoelasticity temperature dependence similar to that shown in FIG. 16 was observed.

Figure 17:
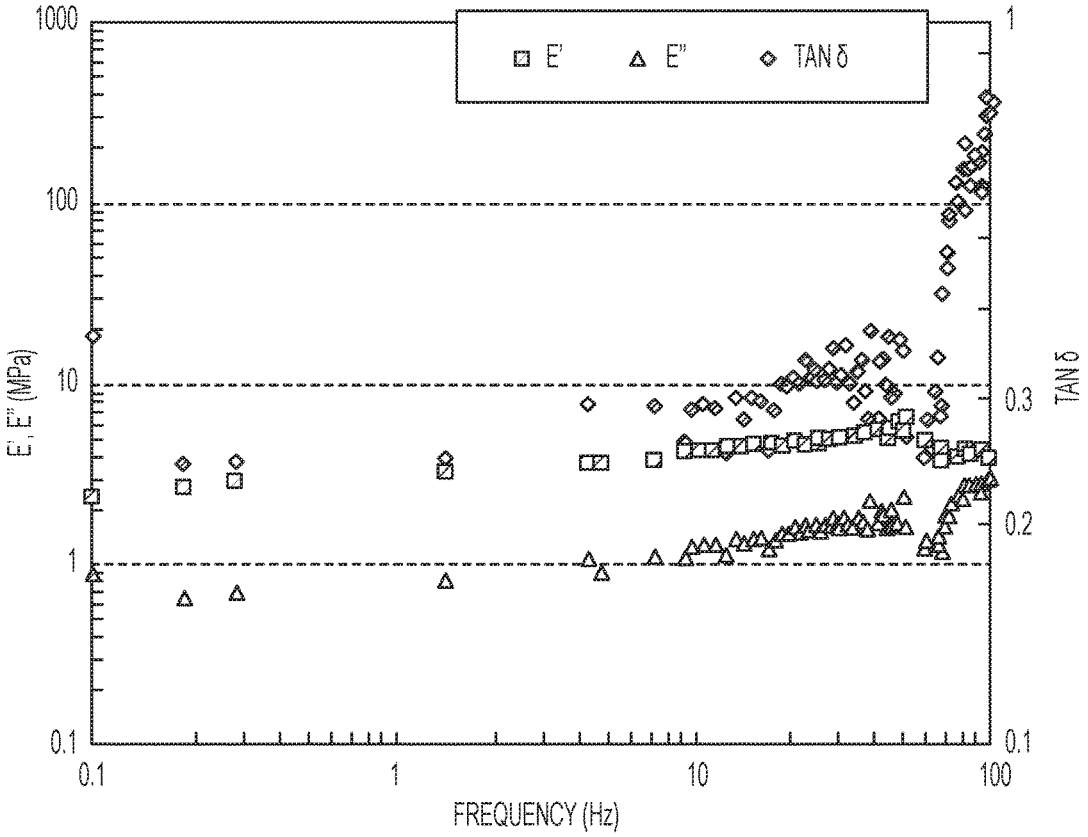
FIG. 17 is a graph showing dynamic viscoelasticity frequency dependence observed for one example of a film used in the film layer.

FIG. 17 is a graph showing the dynamic viscoelasticity frequency dependence observed for a film made according to Example 1. In FIG. 17 the horizontal axis represents frequency, while the first vertical axis represents the storage elastic modulus E' and the loss modulus E" and the second vertical axis represents tan δ. Here, tan δ is the tangent of the ratio of the loss modulus E" to the storage elastic modulus F (E"/E') at a temperature of 25° C. The measurements shown in FIG. 17 were made using a viscoelasticity measuring apparatus (TA instruments Inc., RSA-G2). Measurement conditions were as follows: measurement temperature: 25° C.; measurement mode: tensile; displacement amplitude: set to 12.5 μm. For the composite fabric produced in Example 1, tan δ was 0.25 or greater within a range of 0.1 to 100 Hz. For the composite fabric produced in Example 1, E' and E" increased monotonically as frequency increased. That is, E' and E" were higher during, frequencies associated with exercise (10 to 100 Hz) than frequencies associated with rest (0.1 to 1 Hz), and tan δ increased with increasing frequency. In particular, tan δ increased dramatically from 10 to 100 Hz. Based on these results, it is clear that the composite fabric produced in Example 1 reinforces the motion of human muscles during exercise without burdening the muscles during rest. Furthermore, the composite fabric produced in Example 1 is comfortable when worn on the human body, both when the body is at rest as well during exercise. Note that when only the synthetic resin layer film was measured, a dynamic viscoelasticity frequency dependence similar to that shown above was observed.

Figure 18:
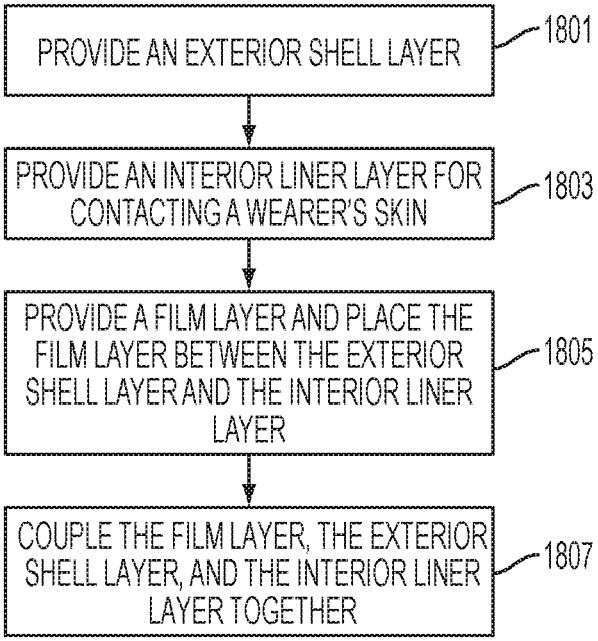
FIG. 18 illustrates a method for constructing a front panel for a sports bra.

With reference to FIG. 18, a method for constructing a front panel 10 for a sports bra 9 that stiffens upon movement of a wearer's breasts is disclosed. The method includes providing an exterior shell layer 12, as shown at 1801. The method also includes providing an interior liner layer 44 for contacting a wearer's skin, as shown at 1803. As shown at 1805, a film layer 36 is also provided and placed between the exterior shell layer 12 and the interior liner layer 44. The method next includes coupling, the film layer 36, the exterior shell layer 12, and the interior liner layer 44 together, as shown at 1807. In one example, the coupling is performed by sewing. The coupling could also be done by Bemis tape, ultrasonic bonding, or gluing. According to one example of the present disclosure, the film layer 36 comprises a thermally-induced shape memory polymer that exhibits viscoelastic properties when at body temperature and stiffens to absorb between about 0.015 N and about 0.03 N of force at frequencies of breast movement of about 6 Hz to about 15 Hz.

In one example of the method, the film layer 36 is formed as a mesh. The mesh may be formed by placing a melted composition of SMP in a mold sized and shaped to produce a mesh having a thickness between about 0.15 mm and about 0.30 mm, and cooling the melted composition in the mold. The formed mesh may have a hole density of 480 holes/in$^2$. The hole to SMP ratio of the mesh may be 1:4. In one example, the mesh may have a weight of about 136.8 g/m$^2$ and a thickness of 0.22 mm, where both figures may vary by +/−10%. Such a mesh may have the following properties:

| | | Length | Width |
|---|---|---|---|
| Tensile Force (N/in$^2$) | 20% | 13.2 | 9.2 |
| | 40% | 20.0 | 14.6 |
| | 60% | 24.6 | 18.2 |
| | 80% | 28.6 | 21.3 |
| Breaking Force (N/in$^2$) | | 84.5 | 51.0 |
| Tensile Strength (MPa) | 20% | 1.2 | 0.8 |
| | 40% | 1.8 | 1.3 |
| | 60% | 2.2 | 1.7 |
| | 80% | 2.6 | 1.9 |
| Breaking Strength (MPa) | | 7.6 | 4.6 |

Alternatively, the film layer 36 can be formed via intaglio printing techniques, including gravure printing. A suitable catalyst can be added and melted into the bifunctional diisocyanate, bifunctional polyol and bifunctional chain extender mixture prepared at the above mentioned ratio range of 2.00-1.10:1.00:1.00-0.10 as needed to prepare a molten synthetic resin material. Given formability considerations, the molten synthetic resin material should show a viscosity ranging from 500 to 5,000 Pa·s at the relevant molding temperature (190 to 230° C.) with a range of 1,000 to 2,000 Pa·s preferable. The type (molecular weight) and relative proportions of the bifunctional diisocyanate, bifunctional polyol and bifunctional chain extender are selected in order to satisfy the above viscosity constraints. A plate corresponding to the shape of the synthetic resin layer is set within a priming apparatus. Prepared molten synthetic resin material is fed onto the printing apparatus plate and printed onto a release sheet. In this way a film is prepared on the release sheet. The film may be peeled off and used alone, or the release sheet may be bonded to a natural, synthetic, or natural/synthetic blend fabric. When the release sheet is peeled off, the film is transferred onto the fabric to form a synthetic resin layer thereon.

Alternatively, a synthetic resin film constituting a single continuous film can be formed on the fabric, after which part of the film is removed, in order to form a synthetic resin layer on the fabric. For example, the above mentioned bifunctional diisocyanate, bifunctional polyol and bifunctional chain extender mixture starting material can be cross-linked, after which it is mixed with a suitable solvent to prepare a synthetic resin solution. The synthetic resin solution is then applied to the surface of the fabric using known methods (e.g., screen printing). Subsequently, part of the synthetic resin film is removed via mechanical puncturing or laser treatment.

After it is formed, the mesh film or mesh film/fabric composite may be formed into a first breast cup 40*a* and a second breast cup 40*b* within a second mold. Care should be taken not to heat the mold to temperatures that will damage the properties of the film. Alternatively, the first and second breast cups can be formed while the mesh is first being cooled from its molten state in the mold or on the plate that was used to mate the mesh in the first place. After the mesh film or mesh film/fabric composite has been removed from the mold, the method may further include cutting or stamping a first aperture 42*a* at an apex of the first breast cup 40*a* and a second aperture 42*b* at an apex of the second breast cup 40*b*, the first and second apertures 42*a*, 42*b* configured to allow a wearer's breast tissue to project there through when the bra is being worn. If the mesh film is created using a printing technique, the apertures 42*a*, 42*b* may be formed by leaving unprinted areas. The method may further comprise molding the first and second breast cups 40*a*, 40*b* to a concave shape that approximates a shape of the wearer's breasts that is predetermined based on breast size, i.e., the graduation of the mold is changed based on the breast size for which the breast cup is molded.

The interior liner layer 44 can also be molded to create breast cups 45*a*, 45*b*, which can then be aligned with the breast cups 40*a*, 40*b* and apertures 42*a*, 42*b* of the film layer 36 as the two layers are combined to form the front panel 10 of the bra 9.

In the above description certain terms have been used for brevity, clarity, and understanding. No unnecessary limitations are to be inferred therefrom beyond the requirement of the prior art because such terms are used for descriptive purposes and are intended to be broadly construed. The different articles of manufacture and methods described herein above may be used in alone or in combination with other articles of manufacture and methods.

What is claimed is:

1. A front panel for a sports bra comprising:

an interior liner layer having a back face configured to contact a wearer's skin, and having a size and shape configured to substantially cover the wearer's breasts;

an exterior shell layer having a back face facing a front face of the interior liner layer, having a size and shape configured to substantially cover the wearer's breasts, and coupled to the interior liner layer; and a film layer located between the front face of the interior liner layer and the back face of the exterior shell layer, wherein the film layer comprises a thermally-induced shape memory polymer having viscoelastic properties when at body temperature of the wearer;

wherein, when the front panel is worn as part of a sports bra, the film layer stiffens as a frequency of movement of the wearer's breasts increases, thereby absorbing forces caused by the movement of the wearer's breasts, and wherein the thermally-induced shape memory polymer stiffens to absorb energy at frequencies of breast movement of between 1 Hz and 100 Hz and is capable of absorbing a force of up to 0.03 N.

2. The front panel of claim 1, wherein the thermally-induced shape memory polymer is configured to stiffen to absorb between 0.015 N and 0.03 N of force at frequencies of breast movement of between 6 Hz and 15 Hz.

3. The front panel of claim 1, wherein the film layer comprises a first breast cup and a second breast cup.

4. The front panel of claim 3, wherein the film layer has a first aperture at an apex of the first breast cup and a second aperture at an apex of the second breast cup.

5. The front panel of claim 3, wherein the first and second breast cups are molded to a concave shape.

6. The front panel of claim 1, further comprising an internal fabric layer coupled between the back face of the exterior shell layer and a front face of the film layer.

7. The front panel of claim 1, wherein the thermally-induced shape memory polymer is a polyurethane elastomer comprising a bifunctional diisocyanate, a bifunctional polyol and a bifunctional chain extender polymerized at a molar ratio of 2.00-1.10:1.00:1.00-0.10 using one of a pre-polymer method and a bulk method, and wherein the film layer has multiple apertures at an aperture ratio of ranging from 10 to 90%.

8. The front panel of claim 7, wherein the film layer comprises a layer of fabric and a layer of the thermally-induced shape memory polymer coating at least one side of the layer of fabric.

9. The front panel of claim 7, wherein a molecular weight of the bifunctional diisocyanate ranges from 174 to 303, a molecular weight of the bifunctional polyol ranges from 300 to 2,500, and the bifunctional chain extender is a diol or diamine with a molecular weight ranging from 60 to 360.

10. A front panel for a sports bra comprising:

an interior liner layer having a back face configured to contact a wearer's skin, and having a size and shape configured to substantially cover the wearer's breasts;

an exterior shell layer having a back face facing a front face of the interior liner layer, having a size and shape configured to substantially cover the wearer's breasts, and coupled to the interior liner layer; and a film layer located between the front face of the interior liner layer and the back face of the exterior shell layer, wherein the film layer comprises a thermally-induced shape memory polymer having viscoelastic properties when at body temperature of the wearer;

wherein, when the front panel is worn as part of a sports bra, the film layer stiffens as a frequency of movement of the wearer's breasts increases, thereby absorbing forces caused by the movement of the wearer's breasts, and wherein the thermally-induced shape memory polymer stiffens to absorb energy at frequencies of breast movement of between 1 Hz and 100 Hz and is capable of absorbing a force of up to 0.03 N; and wherein the thermally-induced shape memory polymer is a polyurethane elastomer comprising a bifunctional diisocyanate, a bifunctional polyol and a bifunctional chain extender polymerized at a molar ratio of 2.00-1.10:1.00:1.00-0.10 using one of a pre-polymer method and a bulk method, and wherein the film layer has multiple apertures at an aperture ratio of ranging from 10 to 90%.

11. The front panel of claim 10, wherein the thermally-induced shape memory polymer is configured to stiffen to absorb between 0.015 N and 0.03 N of force at frequencies of breast movement of between 6 Hz and 15 Hz.

12. The front panel of claim 10, wherein the film layer comprises a first breast cup and a second breast cup.

13. The front panel of claim 12, wherein the film layer has a first aperture at an apex of the first breast cup and a second aperture at an apex of the second breast cup.

14. The front panel of claim 12, wherein the first and second breast cups are molded to a concave shape.

15. The front panel of claim 10, further comprising an internal fabric layer coupled between the back face of the exterior shell layer and a front face of the film layer.

16. The front panel of claim 10, wherein the film layer comprises a layer of fabric and a layer of the thermally-induced shape memory polymer coating at least one side of the layer of fabric.

17. The front panel of claim 10, wherein a molecular weight of the bifunctional diisocyanate ranges from 174 to 303, a molecular weight of the bifunctional polyol ranges from 300 to 2,500, and the bifunctional chain extender is a diol or diamine with a molecular weight ranging from 60 to 360.

* * * * *